US005701695A

United States Patent [19]

Current

[11] Patent Number: 5,701,695

[45] Date of Patent: Dec. 30, 1997

[54] HEIGHT ADJUSTABLE FRAMED SIGN HOLDER

[75] Inventor: Wayne A. Current, Holmdel, N.J.

[73] Assignee: International Visual Corp., Port Washington, N.Y.

[21] Appl. No.: 735,824

[22] Filed: Oct. 23, 1996

Related U.S. Application Data

[63] Continuation of Ser. No. 498,218, Jul. 5, 1995, abandoned.

[51] Int. Cl.[6] ..... G09F 15/00

[52] U.S. Cl. ..... 40/606; 40/601

[58] Field of Search ..... 40/601, 611, 610, 40/606, 607; 248/125.8; 403/109, 377, 378

[56] References Cited

U.S. PATENT DOCUMENTS

| | | | |
|---|---|---|---|
| 1,274,317 | 7/1918 | Palmenberg | 248/125.8 X |
| 1,312,485 | 8/1919 | Krauth | 403/377 X |
| 2,102,972 | 12/1937 | Phillips | 40/611 |
| 2,664,259 | 12/1953 | Rose | 403/109 X |
| 3,579,880 | 5/1971 | Murphy | 40/601 X |
| 4,329,800 | 5/1982 | Shuman | 40/606 |
| 4,368,586 | 1/1983 | Forzelias | 40/604 |
| 4,574,726 | 3/1986 | Sullivan | 40/610 X |
| 4,583,482 | 4/1986 | Smith | 40/610 X |
| 4,706,915 | 11/1987 | Cindric et al. | 248/125.8 |
| 4,858,926 | 8/1989 | Cabianca | 403/109 X |
| 5,152,627 | 10/1992 | Arnold | 403/109 |
| 5,387,048 | 2/1995 | Kuo | 403/109 |
| 5,471,899 | 12/1995 | Twomlow | 403/109 X |

*Primary Examiner*—Joanne Silbermann
*Attorney, Agent, or Firm*—Collard & Roe, P.C.

[57] ABSTRACT

A device for displaying a sign at various heights including a sign holder and a base. The sign holder includes a framed transparent window with hollow frame members disposed along the lateral sides of the sign holder. The sign is removably mounted to the transparent window. The base includes upwardly extending support rods for frictionally and slidably engaging the hollow interior of the frame member. The sign holder and sign are selectively maintained at various heights along the support rod. Upon completely lowering the sign holder, the support rods are completely disposed within the hollow frame members, providing an aesthetically pleasing appearance.

6 Claims, 1 Drawing Sheet

HEIGHT ADJUSTABLE FRAMED SIGN HOLDER

This is a continuation of application Ser. No. 08/498,218 filed on Jul. 5, 1995, now abandoned.

BACKGROUND OF THE INVENTION

1. Field of the Invention

The present invention relates to a height-adjustable framed sign holder. More particularly, it relates to a framed translucent panel assembly on which the sign is mounted and which is height adjustable with respect to a base.

2. Prior Art

Conventional display devices are commonly used for displaying a sign which is removably mounted to a card-holder. Many prior art display devices are non-adjustable and are manufactured as integral units with fixed heights and framed areas.

The prior art discloses certain attempts to provide adjustable display devices, for example, U.S. Pat. No. 4,329,800 and U.S. Pat. No. 4,368,586. Although these prior art devices overcome certain problems, they still have numerous drawbacks. For example, upon completely lowering the sign, parts of the adjustment mechanism are still visible. Therefore, it would be desirable to provide a height adjustable framed sign holder in which the adjustment mechanism is completely hidden upon completely lowering the sign holder.

SUMMARY OF THE INVENTION

It is therefore an object of the present invention to overcome the drawbacks of the prior art and to provide a height adjustable framed sign holder which is simply and easily manufactured.

It is a further object of the present invention to provide a height adjustable framed sign holder where the adjustment mechanism is completely hidden from view upon fully lowering the sign holder.

These and other related objects are achieved according to the invention by a device for displaying a sign at various heights comprising a sign holder including a periphery with the first lateral side and the frame member extending along the lateral side. The sign is removably mounted to the sign holder. A base is provided which includes upwardly extending support means for frictionally and slidably engaging the frame member, so that the sign holder and the sign are selectively maintained at various heights with respect to the base. The sign holder comprises two translucent panels. The sign is sandwiched between the two panels so that the sign remains flat and visible through the translucent panels.

The frame member comprises a hollow interior bordered by an interior surface. The support means is telescopically disposed within the hollow interior and frictionally engages the interior surface. The frame member is longer than the support means so that upon completely lowering the sign holder, the support means is completely disposed within the hollow interior with the frame member contacting the base.

The support means comprises an axially-extending rod with a top end and an outwardly biased retaining element disposed at the top end for frictionally contacting the interior surface. The retaining element is made from a resilient material and is axially compressed onto the top end of the rod.

The sign holder periphery includes a second lateral side parallel to the first lateral side with the frame member additionally extending at least along the second lateral side. The support means comprises a pair of parallel rods oriented and spaced to slidably engage the frame member at the first and second lateral sides. The frame member additionally extends along the entire periphery to frame the displayed sign. The frame member has a slot formed therein for mounting and removing the sign from the sign holder.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
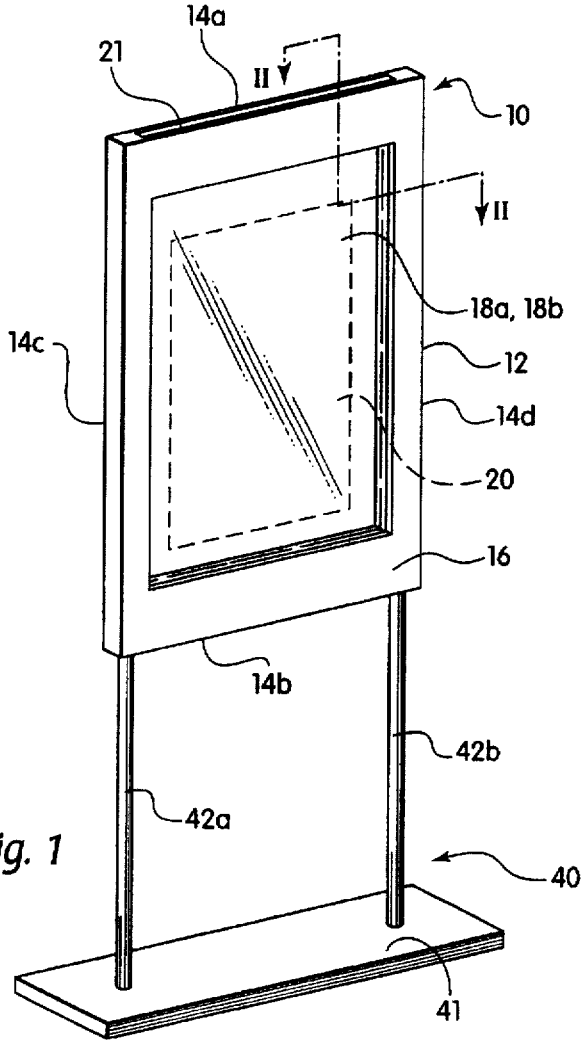
FIG. 1 is a perspective view of a height adjustable framed sign holder according to the invention.

Turning now in detail to the drawings and in particular, FIG. 1 there is shown a device according to the invention having a sign holder 10 slidably mounted on base 40. Sign holder 10 is a framed sign holder consisting of central panels 18*a* and 18*b* surrounded at their periphery 12 by a frame member 16. The periphery of panels 18*a* and 18*b* consists of a top 14*a*, a bottom 14*b*, a first lateral side 14*c*, and a second lateral side 14*d*.

Figure 2:
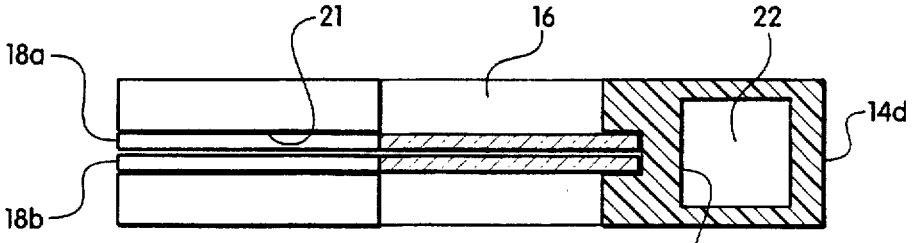
FIG. 2 is a cross-sectional view taken along the line II—II, from FIG. 1.

As can be seen in FIGS. 1 and 2 a slot 21 is formed along top 14*a*. A sign 20 is removably disposed between panels 18*a* and 18*b* through slot 21. Within lateral sides 14*c* and 14*d* there is provided a hollow interior 22 which is bordered by an interior surface 24. Although hollow interior 22 is shown with a square cross-section, other suitable shapes may be provided, as will be discussed in greater detail below.

Figure 3A:
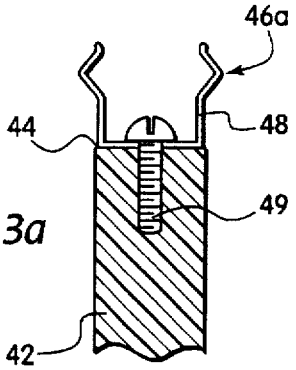
FIG. 3*a* is a front, side elevational view of the support rod and retaining element.
Figure 3B:
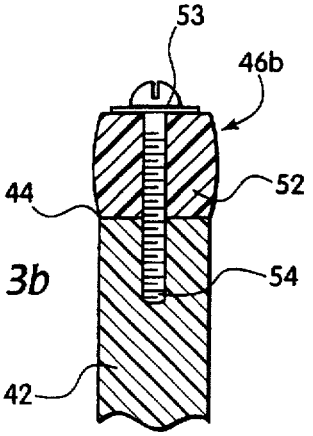
FIG. 3*b* is a front, side elevational view of the support rod with an alternate embodiment of the retaining element.

Base 40 includes upwardly-extending support rods 42*a* and 42*b*. These support rods are telescopically disposed within hollow interiors 22 within lateral sides 14*c* and 14*d*. As can be seen in FIGS. 2, 3*a* and 3*b*, support rods 42 have an outer dimension which is slightly smaller than the dimensions of hollow interior 22. At the top end 44 of each support rod 42 there is a retaining element 46*a* or 46*b*. The retaining element is outwardly biased to frictionally engage interior surface 24. In FIG. 3*a*, retaining element 46*a* consists of a metal clip 48 which is attached to the support rod by an axially-extending screw 49. In the unbiased state, metal clip 48 has a width larger than hollow interior 22. Upon placing metal clip 48 within hollow interior 22, the upwardly-extending arms of metal clip 48 are forced inwardly toward each other, thus exerting a biasing force against interior surface 24. This biasing force results in frictional engagement between support rods 42 and sign holder 10. As a result sign holder 10 may be forcibly raised or lowered along support rods 42 to select a vertical position of sign holder 10. Upon release of sign holder 10, the frictional force exerted by metal clip 48 against interior surface 24, maintains sign holder 10 in the selected position. The upwardly-extending arms of metal clip 48 may be manually bent toward or away from each other to decrease or increase, respectively, the frictional force against interior surface 24. Metal clip 48 is made from spring steel, for example.

As can be seen in FIG. 3*b*, retaining element **46*b* consists of a resilient, hollow cylinder 52 which is mounted on top end 44 with a washer 53 and an axially-extending screw 54. The resilient retaining element 52 has an outer dimension slightly larger than hollow interior 22. Accordingly the cylindrical retaining element 52 contacts the center of each of the four walls which defines interior surface 24. To adjust the frictional force between resilient retaining element 52 and interior surface 24, axially-extending screw 54 may be tightened or loosened. As screw 54 is tightened, resilient retaining element 46*b* is compressed between washer 53 and top end 44. This compression causes resilient retaining element 46*b* to bulge laterally outwardly to increase the contact area against interior surface 24. Retaining element 52** is made from resilient rubber or urethane, for example.

Frame member 16 may be formed out of two plastic shells which are ultrasonically welded together. Alternatively frame member 16 may be fabricated as a wooden frame with hollow interior 22 milled out of each lateral side **14*c* and 14*d*. As can be appreciated, metal clip 48 would operate most efficiently when expanding against two parallel-opposed side walls. These parallel-opposed side walls could be part of a hollow interior having a square or rectangular cross-section. Resilient retaining element 52 could also be placed within a rectangular, circular, oval or other suitably-shaped hollow interior section. Although a variety of retaining elements may be utilized, certain key features are intrinsic to the operation of the sign holder. Rods 42 are not intended to contact interior surface 24. This is because in the raised position, as shown in FIG. 1, support rods 42 are visible. In order to contribute to the overall aesthetics of the sign holder, support rods 42 should not be marred or scratched due to frictional contact with interior surface 24. Only the retaining elements will frictionally contact interior surface 24**. The hollow interior may take any shape which freely accommodates support rods while providing a sufficient frictional force upon engagement with the retaining elements.

Finally lateral sides **14*c* and 14*d* have a length such that the respective hollow interiors 22 are longer than support rods 42. Upon completely lowering sign holder 10, support rods 42 are completely disposed within hollow interiors 22, with bottom side 14*b* contacting base plate 41. In the lowered position, the structure contributing to the adjustability of sign holder 10** is completely hidden and an aesthetically-pleasing, compact sign holder is provided.

While several embodiments of the present invention have been shown and described, it is to be understood that many changes and modifications may be made thereunto without departing from the spirit and scope of the invention as defined in the appended claims.

What is claimed is:

1. A framed sign holder for demountably receiving and displaying a sign at various heights comprising:

a base including two spaced-apart, upwardly-extending support elements; and a frame with two spaced apart, vertical side members and a bottom portion connected between said side members, each side member having a hollow interior for slidably and frictionally receiving one of said support elements;

means for frictionally maintaining the position of each of said support elements within the hollow interior of each of said vertical side members, said means disposed entirely within the hollow interior of each of said side members so that said frame is selectively raised and lowered along said upwardly-extending support elements and maintained in position by friction to display the sign at various heights, wherein the frame may be lowered so that the support elements are disposed entirely within the side members and thus hidden from view.

2. The sign holder according to claim 1, comprising two translucent panels retained in an overlying relationship by said frame and being adapted to sandwich the sign therebetween so that the sign remains flat and visible through said translucent panels.

3. The sign holder according to claim 1, wherein said side members are longer than said support elements so that upon completely lowering said frame, said support elements are completely disposed within the hollow interior with said frame contacting said base.

4. The sign holder according to claim 3, wherein each of said support elements comprise an axially-extending rod with a top end and wherein the means for frictionally maintaining the position of each of said support elements comprises an outwardly-biased retaining element disposed at said top end for frictionally contacting said side members.

5. The sign holder according to claim 4, wherein said retaining element is made from a resilient material and is axially compressed onto said top end of said rod.

6. The sign holder according to claim 1, wherein said frame additionally includes a top portion having a slot formed therein adapted for slidingly receiving and removing the sign from said frame.

* * * * *